US006920972B2

(12) United States Patent
Speas et al.

(10) Patent No.: US 6,920,972 B2
(45) Date of Patent: Jul. 26, 2005

(54) COIN FRAUD DETECTION SENSING SYSTEM AND METHOD

(75) Inventors: Gary W. Speas, Little Rock, AR (US); Seth Ward, II, Little Rock, AR (US)

(73) Assignee: POM, Incorporated, Russellville, AR (US)

( * ) Notice: Subject to any disclaimer, the term of this patent is extended or adjusted under 35 U.S.C. 154(b) by 100 days.

(21) Appl. No.: 10/358,018

(22) Filed: Feb. 3, 2003

(65) Prior Publication Data

US 2003/0217905 A1 Nov. 27, 2003

Related U.S. Application Data

(60) Provisional application No. 60/353,386, filed on Feb. 1, 2002.

(51) Int. Cl.[7] ..... G07D 5/00
(52) U.S. Cl. ..... 194/203
(58) Field of Search ..... 194/202, 203, 194/302, 344; 73/163

(56) References Cited

U.S. PATENT DOCUMENTS

| | | | | |
|---|---|---|---|---|
| 3,587,809 A | | 6/1971 | Meloni | 194/100 |
| 3,998,309 A | * | 12/1976 | Mandas et al. | 194/203 |
| 4,257,435 A | | 3/1981 | Tanaka et al. | 133/3 R |
| 4,267,916 A | | 5/1981 | Black | 194/102 |
| 4,326,621 A | | 4/1982 | Davies | 194/100 A |
| 4,356,903 A | | 11/1982 | Lemelson et al. | 194/1 R |
| 4,483,431 A | | 11/1984 | Pratt | 194/97 A |
| 4,542,817 A | * | 9/1985 | Paulson | 194/203 |
| 4,546,868 A | * | 10/1985 | Gregory, Jr. | 194/203 |
| 4,565,275 A | * | 1/1986 | Hagiwara | 194/203 |
| 4,601,380 A | | 7/1986 | Dean et al. | 194/318 |
| 5,180,046 A | | 1/1993 | Hutton et al. | 194/319 |
| 5,568,855 A | | 10/1996 | Hoffman et al. | 194/318 |
| 5,687,829 A | | 11/1997 | Churchman | 194/317 |
| 6,003,651 A | * | 12/1999 | Waller et al. | 194/202 |
| 6,026,946 A | * | 2/2000 | McCarty, Jr. | 194/317 |
| 6,155,398 A | * | 12/2000 | Sagady | 194/200 |
| 6,736,250 B2 | * | 5/2004 | Mattice | 194/203 |
| 6,749,052 B2 | * | 6/2004 | Carmichael | 194/201 |

FOREIGN PATENT DOCUMENTS

| | | | | |
|---|---|---|---|---|
| GB | 2 077 475 A | | 5/1980 | G07F/17/24 |
| GB | 2 176 038 A | | 5/1986 | G07D/5/02 |
| GB | 2.221.332 A | * | 1/1990 | G07F/3/02 |

* cited by examiner

*Primary Examiner*—Donald P. Walsh
*Assistant Examiner*—Mark Beauchaine
(74) *Attorney, Agent, or Firm*—Conley Rose, P.C.; J. Robert Brown, Jr.

(57) ABSTRACT

A coin fraud detection sensing system is provided that includes a coin chute and one or more sensing devices coupled to the coin chute. The one or more sensing devices are operative to detect a coin or other object in the coin chute and transmit a signal to a processor that determines the travel speed of the coin through the coin chute, the travel direction of the coin through the coin chute or the sequence of signals received from the sensing devices. Based upon the travel speed, direction and/or sequence, the processor is programmed to detect whether the coin is being fraudulently controlled by a withdrawal device, such as a string.

17 Claims, 2 Drawing Sheets

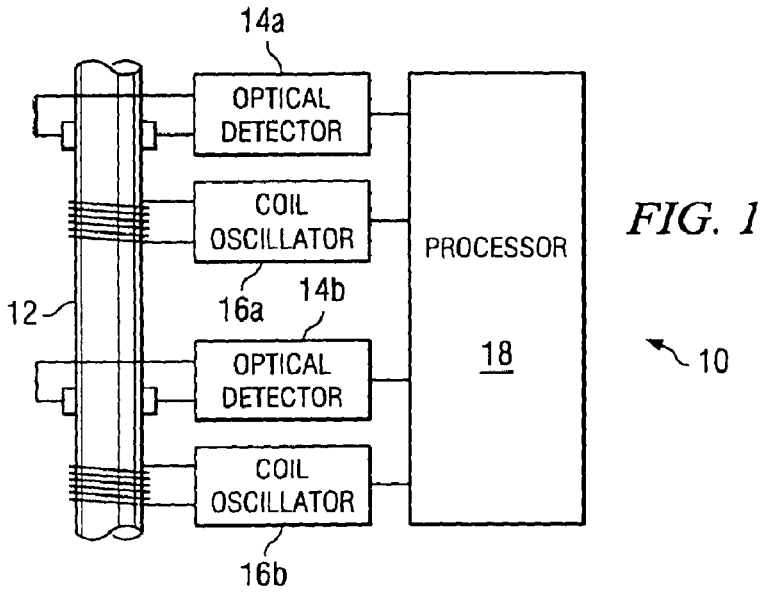
FIG. 1
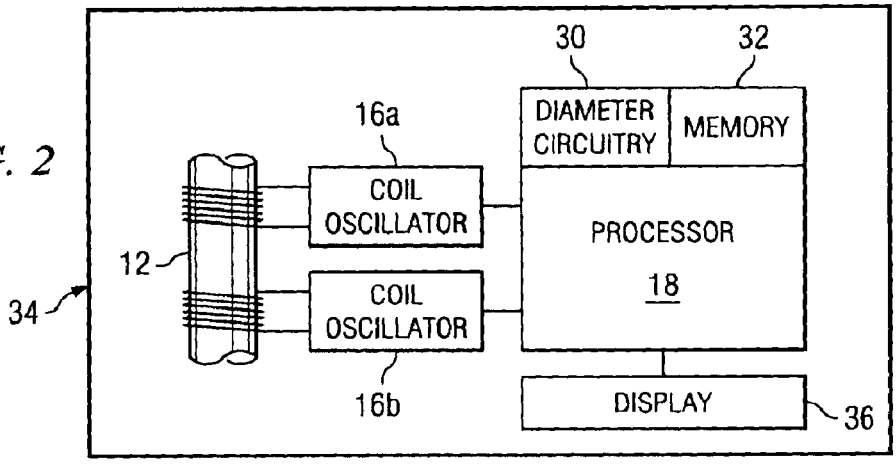
FIG. 2
FIG. 3
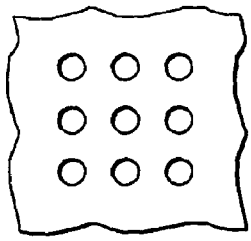

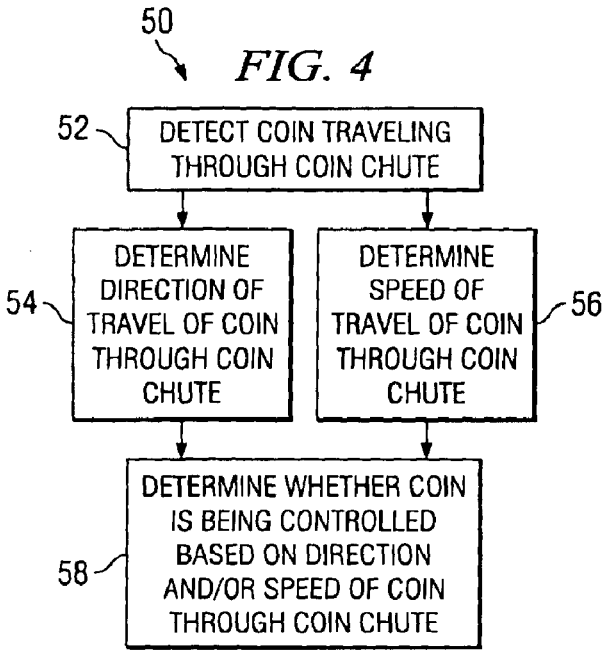
50
FIG. 4
52
DETECT COIN TRAVELING THROUGH COIN CHUTE
54
DETERMINE DIRECTION OF TRAVEL OF COIN THROUGH COIN CHUTE
56
DETERMINE SPEED OF TRAVEL OF COIN THROUGH COIN CHUTE
58
DETERMINE WHETHER COIN IS BEING CONTROLLED BASED ON DIRECTION AND/OR SPEED OF COIN THROUGH COIN CHUTE

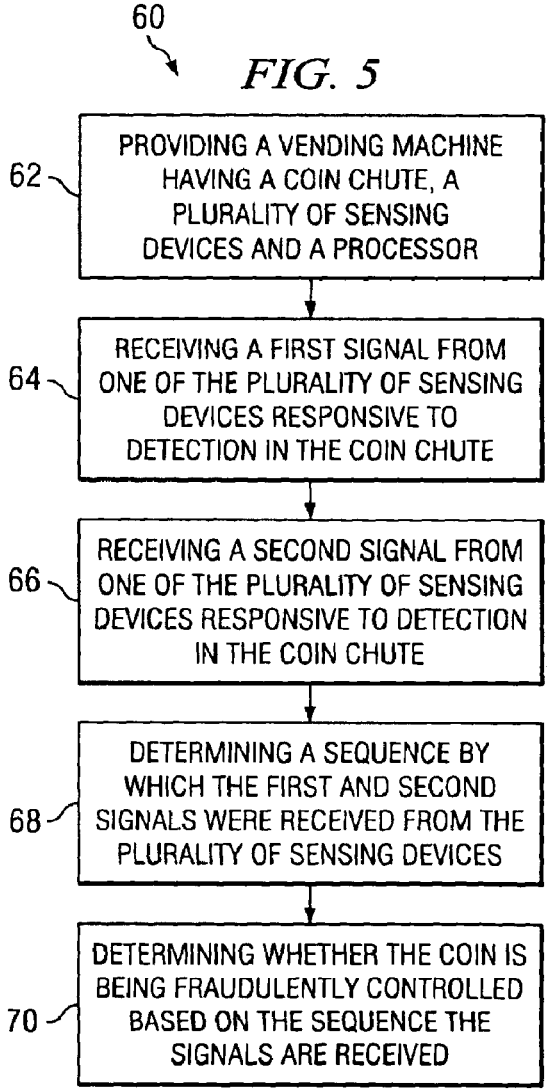
60
FIG. 5
62
PROVIDING A VENDING MACHINE HAVING A COIN CHUTE, A PLURALITY OF SENSING DEVICES AND A PROCESSOR
64
RECEIVING A FIRST SIGNAL FROM ONE OF THE PLURALITY OF SENSING DEVICES RESPONSIVE TO DETECTION IN THE COIN CHUTE
66
RECEIVING A SECOND SIGNAL FROM ONE OF THE PLURALITY OF SENSING DEVICES RESPONSIVE TO DETECTION IN THE COIN CHUTE
68
DETERMINING A SEQUENCE BY WHICH THE FIRST AND SECOND SIGNALS WERE RECEIVED FROM THE PLURALITY OF SENSING DEVICES
70
DETERMINING WHETHER THE COIN IS BEING FRAUDULENTLY CONTROLLED BASED ON THE SEQUENCE THE SIGNALS ARE RECEIVED

COIN FRAUD DETECTION SENSING SYSTEM AND METHOD

CROSS-REFERENCE TO RELATED APPLICATIONS

Pursuant to 35 U.S.C. § 119(e), this application claims the benefit of U.S. Provisional Patent Application Ser. No. 60/353,386, entitled *Coin Fraud Detection Sensing System and Method*, filed Feb. 1, 2002, naming Gary W. Speas and Seth Ward II as inventors, which is hereby incorporated by reference for all purposes.

TECHNICAL FIELD OF THE INVENTION

This invention relates in general to the field of coin-operated vending machines and more particularly to a system and method of detecting fraudulent control of a coin inserted into coin-operated vending machines.

BACKGROUND OF INVENTION

Mechanical parking meters were originally developed for insertion of coins or tokens through a coin slot into a coin chute that would facilitate gauging the size of the coins before dropping them into a coin box. Based on the size of the coin, the appropriate time would be wound onto the meter and displayed with a pointer and dial. This method required inserting the coins into their proper slots and turning a handle. Mechanical meters could not distinguish a valid coin from an object the size of a valid coin. Also, this method was prone to jamming and would require partial disassembly of the meter to repair the jams.

Electronic meters were later developed with free-fall coin shoots with electronic methods of gauging coins and with straight fall into the coin box that would make jams less frequent and easier to clear. However, this design gave way to a new method of cheating the parking meters by controlling and retrieving the coin or token with a string, such as an ordinary string or fishing line, ribbon, plastic straw, or other attachments. The "coin-on-a-string" trick allowed the coin to be recovered after purchasing time and/or could be used to purchase multiple increments of time thereafter.

A mechanical "catch" inside the coin shoot has been employed to stop retrieval of a coin or token, but when the catch forced upward, the catch may cause jams in the coin shoot, may break off completely or otherwise render the parking meter inoperable. Additionally, a rigid attachment of the coin, such as to a flat piece of plastic or a flattened drinking straw, can actually flatten the catch against the wall of the coin shoot and holding down the catch while the coin passes over and is then retrieved.

For this reason, a need exists for an improved system and method for detecting fraudulent control of coins inserted into vending machines, such as parking meters, that overcomes the shortcomings of prior systems.

SUMMARY OF THE INVENTION

The present system and method utilizes coin discrimination components to determine the size and metallic content of objects, such as coins, passing through electromagnetic fields or infrared beams to determine a valid coin or token, while simultaneously sensing its direction of movement and speed through the coin shoot to detect fraudulent control of coins.

One advantage of the present invention is that no additional coin sensing or detecting components are necessary to detect fraudulent control of a coin, optimizing power consumption, which is critical in vending machines that operate on batteries such as parking meters. A novel aspect of the present invention is that a processor is programmed to utilize existing electromagnetic or optical detectors, which are ordinarily employed as coin discrimination components, and, utilizing one of the novel aspects of the present invention, the processor receives information from these components and determines the direction that the coin is traveling through the coin chute of the vending machine and further determines the speed of the coins through the coin chute of the vending machine.

Thus, coins or tokens that would otherwise be identified as valid, but are actually falling at an abnormal speed and/or traveling in an incorrect direction, will produce a different response from the present invention, such as by showing no time on the meter, displaying a special message on the display, timing-out the vending device, alarm signaling or other appropriate responses.

A coin fraud detection sensing system is provided that includes a coin chute and an electronic sensing device coupled to the coin chute. The sensing device is operative to determine the speed of travel of a coin through the coin chute to indicate that the coin is being used or controlled fraudulently. In another aspect, the present invention provides a coin fraud detection sensing system that includes a coin chute and an electronic sensing device coupled to the coin chute. The sensing device is operative to determine a direction of travel of the coin through the coin chute to indicate that the coin is being used fraudulently.

In other aspects it may be advantageous to provide one or more sensing devices coupled to the coin chute. In this aspect, the sensing devices may be coupled to a processor adapted to receive information indicative of the travel direction and travel speed of the coin from the one or more sensing devices and based on the information, the processor determines whether the coin is being used fraudulently.

In one aspect, the present invention includes a method for coin fraud detection, the method includes sensing a travel direction of a coin in a chute and determining, based upon the travel direction of the coin, whether the coin is being used fraudulently. In another aspect, the present invention includes a method for coin fraud detection, the method includes sensing a travel speed of the coin in a chute and determining, based upon the travel speed of the coin, whether the coin is being used fraudulently.

In yet another aspect, the method may include both sensing the travel speed and travel direction of the coin in the chute and determining based upon the travel speed and direction of the coin whether the coin is being used fraudulently.

In other aspects, the present invention is directed to a parking meter having a coin chute and a first and second sensing device coupled to the coin chute. The first sensing device is operative to determine the speed of the coin. The second sensing device is coupled to the coin chute and operative to determine a direction of travel of the coin in the coin chute. A processor is coupled to the first and second sending devices and operative to receive information indicative of the travel direction and travel speed of the coin through the coin chute and further operative to determine whether the coin is being used fraudulently.

In one aspect the present invention includes a means for sensing the travel direction of the coin and may in other aspect include a means for sensing the travel speed. In yet other aspect, the present invention may be implement by a vending machine instead of a parking meter. In one aspect the sensing device and sensing means may be an optical sensor, while in other aspects the sensing means may be an RF or coil oscillator, Hall effect sensor or other electromagnetic sensor.

According to one aspect, the present invention is directed to a method for electronically detecting fraudulent control of a coin in a vending machine. The method includes detecting a coin traveling through a coin chute of a vending machine and determining either a direction of travel of the coin through the coin chute and/or a speed of travel of the coin in the coin chute of the vending machine.

The method includes determining that the coin is being fraudulently controlled based upon an improper direction of travel or an inappropriate speed of the coin through the coin chute.

Other technical advantages are readily apparent to one skilled in the art from the following figures, description, and claims.

BRIEF DESCRIPTION OF THE DRAWINGS

For a more complete understanding of the present invention and the advantages thereof, reference is now made to the following brief description, taken in connection with the accompanying drawings and detailed description, wherein like reference numerals represent like parts, in which:

FIG. 1 is a block diagram of one aspect of the present invention illustrating a coin chute and a plurality of sensing devices coupled to the coin chute;

FIG. 2 is a block diagram of another aspect of the present invention illustrating a processor in communication with a memory component and a diameter circuitry;

FIG. 3 illustrates an array of optical detectors that are employed according to one aspect of the present invention;

FIG. 4 is a flow-chart of a method for detecting a fraudulently controlled coin, according to one aspect of the present invention; and FIG. 5 is a flow-chart of another method for detecting a fraudulently controlled coin, according to another aspect of the present invention.

DETAILED DESCRIPTION OF THE INVENTION

It should be understood at the outset that although an exemplary implementation of the present invention is illustrated below, the present invention may be implemented using any number of techniques, whether currently known or in existence. The present invention should in no way be limited to the exemplary implementations, drawings, and techniques illustrated below, including the exemplary design and implementation illustrated and described herein.

FIG. 1 illustrates one aspect of the present invention of a coin fraud detection sensing system 10 for use by vending machines, such as but not limited to, parking meters. It will be appreciated that vending machines, and particularly parking meters, are subject to fraudulent attacks. In one aspect, the present invention is provides an effective system and method for detecting fraudulent control of coins inserted in vending machines.

Criminals frequently attach control or withdrawal devices, such as string, fishing line, wire, ribbon, plastic straws or other attachments. The coin is deposited in the vending machine to obtain credit for purchases and then retrieved with the withdrawal device. Mechanical means, such as the catch previously discussed, are effective for defeating the coin-on-a-string, but frequently the coin and/or withdrawal device become lodged in the mechanical catch rendering the vending device inoperable and requiring costly repairs.

A free-fall coin chute, without the mechanical catch, avoids these mechanical difficulties and associated repair costs. However, due to the severe power restraints on certain vending devices, such as parking meters, it is problematic to include additional components or system solely for detecting the coin-on-a-string. According to one aspect, the present invention provides an innovative solution to this problem by utilizing existing coin discrimination components and circuitry to detect for a coin-on-a-string. Such coin discrimination circuitry illustrated in U.S. Pat. No. 6,026,946 to McCarty, Jr., which is incorporated herein by reference for all purposes.

Criminals typically attach the withdrawal device to legitimate coins or tokens, washers or other non-legitimate coin-like devices may also be employed and are within the spirit and scope of the present invention, and the term coin is used herein to refer to any device that may be used for these purposes.

The coin fraud detection sensing system 10 includes a coin chute 12 defined as a passageway operable to receive coins there through. According to one aspect of the present invention the coin chute 12 is a free-fall coin chute and eliminates the necessity for a mechanical catch.

The coin fraud detection sensing system 10 also includes a plurality of optical detectors 14 and a plurality of coil oscillators 16 which may also be referred to herein as sensing devices. The optical detectors 14 and coil oscillators 16 may be any number of optical and electromagnetic detectors, such as those illustrated and described in U.S. Pat. No. 6,026,946 to McCarty, Jr., which are well known in the art and their operation and function will not be described for sake of brevity.

The optical detector 14*a*, such as an LED or other optical means, is coupled to the coin chute 12, and is operative to wake-up the vending device (not shown) such as a parking meter or other vending device. The coil oscillators 16 are further coupled to the coin chute 12 and operable to generate an electronic signal, pulse, or pulse-width indicative of a coin traveling down the coin chute 12.

It will be appreciated that one advantage of the coin fraud detection sensing system 10 of the present invention is that many of the components have been previously used in such vending devices for coin discrimination purposes, but their presence, arrangement and functionality has not heretofore been utilized for detecting fraudulent control of a coin in this manner.

In one aspect, the optical detector 14*a*, which was previously utilized only to wake-up the vending device, is utilized to detect the speed and/or direction of travel of a coin down the coin chute 12.

Although only a single optical means is shown on each of the optical detector 14*a* and 14*b*, an array or a plurality of optical detectors, including but not limited to, a plurality of LEDs (light emitting diodes), laser or photo diodes, photo or optical emitters, photo or optical transistors or sensors, CCDs (charged coupled devices) or other optical detection devices well known in the art may be coupled about the coin chute 12 and are all within the spirit and scope of the present invention.

Also, while the present aspect illustrates use of coil oscillators 16*a* and 16*b*, a variety of devices such as REF oscillators, Hall effect sensor as well as other electronic, electromagnetic devices, including electromechanical devices, may be utilized in other aspects and are within the spirit and scope of the present invention as described herein.

Once the optical detector 14*a* has detected a coin traveling down the coin chute 12 and sends a wake-up signal to a processor 18, the optical detector 14*a* remains active for detecting, as previously discussed above, the travel direction and travel speed of the coin.

In one aspect, the optical detectors 14*a* and 14*b*, and the coil oscillators 16*a* and 16*b* are interrupt driven. Thereafter, the coil oscillator 16*a* obtain information relative to the coin passing through the coils of the coil oscillators 16*a* and 16*b* through the coin chute 12. However, the coil oscillator 16*a* may, in some aspects, similar to the optical detector 14*a*, remain active for detecting and sensing information with respect to the travel speed and direction of the coin traveling down the coin chute 12.

It can be seen that by keeping the optical detectors 14 and coil oscillators 16 active, whether by interrupt or otherwise, even after the coin passes by the respective optical detectors 14 and coil oscillators 16, enables information to be gathered with respect to whether or not the coin is traveling in a reverse direction or at an inappropriate speed. A coin that is disposed or connected to a straw or string or other device will travel at a different speed, more slowly for example, as it falls through the coin chute 12 relative to the speed at which the coin would ordinarily fall without such connection.

According to one aspect, the processor 18 is programmed for coin discrimination based on information received from the optical sensors 14*a* and 14*b*, the coil oscillators 16*a* and 16*b*. Utilizing components similar to the optical detectors 14 and coil oscillators 16 the present invention may perform coin discrimination to determine the type of coin deposited in the coin chute 12 and verify that an illegitimate devices, such as a washer or other devices, is identified.

Furthermore, a string or other device coupled to a coin will continue to interfere with and be detected by, for example, the optical detector 14*a*, even after the coin has traveled beyond the coupling point of the optical detector 14*a* to the coin chute 12. In this manner, the optical detectors 14 and 16 can continue to generate and detect information relevant to whether the coin is being used fraudulently.

The optical detectors 14 and coil oscillators 16 may be coupled to the processor 18 which collects, aggregates and analyzes information from the optical detectors 14 and coil oscillator 16 to determine whether the coin is being used fraudulently. It will be appreciated that by analyzing such information with respect to the electromagnetic disturbance created by the coil oscillators 16 and the interference with the optical detectors 14, the processor 18 may make a more accurate determination as to whether or not the coin is being used in a fraudulent manner.

FIG. 2 illustrates another aspect of the present invention utilizing diameter circuitry 30 for coin discrimination. In this aspect, only coil oscillators 16*a* and 16*b* are necessary for coin discrimination and detecting fraudulent control of a coin. The present invention, according to one aspect, determines the speed of travel of the coin based upon a speed dependent diameter calculation.

For example, values for known coins, such as during a training routine or otherwise, are stored in a memory component 32 in communication with the processor 18. The value is based upon information received from the coil oscillators 16 when these coins pass through the coils of the coil oscillators, The information, or signal generated by the coil oscillators 16 is computed by the diameter circuitry 30, processor 18 or a combination of both as being speed dependent in that the signal generated by the coil oscillator (s) 16 varies based upon the speed at which the coin is traveling through the coin chute 12.

Once the information is stored in the memory component 32 for certain coins, subsequent information or signals generated by the coil oscillators 16 is compared to the stored information. Inappropriate coin diameter or coin speed will generate a signal or information received by the processor 18 unlike information stored in the memory component 32 relative to other coins having a correct diameter and normal coin speed. Thus, while the diameter of the coin is useful for coin discrimination, the speed of travel is useful for detecting fraudulent control of the coin.

According to other aspects, the speed may be calculated utilizing other techniques, such as determining the time at which each of the coil oscillators 16 or optical detectors 14 identify the passing of the coin down the coin chute 12 and based on a known distance between such components, the speed of travel can be calculated by the processor 18.

As previously discussed, coin discrimination techniques, as well as methods of ascertaining the speed of coins traveling down the coin chute 12 are well known, such as described in U.S. Pat. No. 6,026,946, and will not be described in detail herein for brevity.

According to one aspect of the present invention, the processor 18 may set a tamper-flag or other variable when fraudulent control of a coin has been detected. Response to the tamper-flag being set, a vending device 34 will time-out for a predetermined time, such as ten minutes or less. During the time-out, the vending device will not give any credit for any deposited coins as a security precaution.

In addition, a display 36 operable for displaying information discernable to the user of the vending machine 34 may display a time-out message in response to a signal received from the processor 18 coupled to the display 36. The time-out message may be a blank screen, error message, warning, time until restored, or other useful messages.

According to another aspect of the present invention, the processor is programmed to analyze the sequence of events of information received by the coil oscillators 16 and optical detectors 14 is to determine whether a coin is being fraudulently controlled. In one aspect, the processor 18 evaluates the information received from the coil oscillator 16*b*, for example In one aspect, one optical detector 14 (not shown in FIG. 2) is employed on the coin chute 14 positioned above the coil oscillators 16*a* and 16*b*. Only where the sequence indicates that the coin has passed the optical detector 14, the upper coil oscillator 16 and then the lower coil oscillator 16*b*, in that order, the processor give credit for the deposited coin. After such sequence, for example, if the next signal or information received by the processor is from the lower coil oscillator 16*b*, the processor is programmed to identify a reverse direction of travel of the coin. Thus, a reverse order of signals of information from the lower coil oscillator 16*b*, upper coil oscillator 16*a* and optical detector 14 indicates the coin has been withdrawn. In such event, the processor is programmed to remove or deduct credit or time, in the case of parking meters, from the vending machine 34. According to other aspects, the processor is programmed to analyze various other sequences of information based upon the order the signals or information is received by the processor or analyze the time where the signal is time-stamped, to detect fraudulent control of a coin.

FIG. 3 illustrates an array of optical detectors 40 that may be utilized for these purposes according to one aspect of the present invention. Various other combinations of only optical detectors 14, or coil oscillators 16 or combinations of both are employed by other aspects and within the spirit and scope of the present invention.

Another important aspect of the present invention is the ultra-low power consumption configuration of the coin fraud detection sensing system 10 in the present invention. In a parking meter type device, power consumption is a significant aspect of any design and configuration. The present invention is useful in that the design is capable of coin discrimination, but is also capable of determining whether a coin is being used fraudulently. Power consumption is minimized by utilizing the same or similar components to accomplish both tasks. This is another advantage of the present invention, when employed in a parking meter where power is a precious commodity and a minimal number of power consuming components is critical to the successful design and deployment in such applications.

FIG. 4 is a flow chart illustrating a method 50 for detecting fraudulent control of coins in a vending machine, such as a parking meter. At a block 52, the method includes detecting a coin traveling through the coin chute 12. The method, at a block 54, provides for determining the direction of travel of the coins through the coin chute 12. According to one aspect of the present method 50, the method may include the step of determining the speed of travel of the coin through the coin chute, such as illustrated at a block 56, which may be in addition to or in combination with determining the direction of travel of the coin, at block 54. In either case, the method further includes determining whether the coin is being controlled based on the direction of travel of the coin through the coin chute 12 and/or based on the speed of the coin traveling through the coin chute 12.

FIG. 5 illustrates a method 60, according to another aspect of the present invention, for detecting whether a coin is being fraudulently controlled. At a block 62, the method includes providing a vending machine, such as the vending machine 34, having the coin chute 12, a plurality of sensing devices, such as the optical sensors 14 and coil sensors 16, and processor 18. At a block 64, the method includes receiving a first signal from one of the plurality of sensing devices responsive to detection in the coin chute 12. At a block 66, the method further provides for receiving a second signal from one of the plurality of sensing devices in response to detection in the coin chute 12.

At a block 68, the method includes determining a sequence by which the first and second signals were received from the plurality of sensing devices, such as by the processor 18. At a block 70, the method provides for determining, such as by the processor 18, whether the coin is being fraudulently controlled based on the sequence by which the first and second signals were received by the processor 18 from the plurality of sensing devices.

Thus, it is apparent that there has been provided, in accordance with the present invention, a coin fraud detection sensing system and method that satisfies one or more of the advantages set forth above. Although the preferred embodiment has been described in detail, it should be understood that various changes, substitutions, and alterations can be made herein without departing from the scope of the present invention, even if all of the advantages identified above are not present. For example, the various elements or components may be combined or integrated in another system or certain features may not be implemented.

Also, the components, techniques, systems, sub-systems, layers, compositions and methods described and illustrated in the preferred embodiment as discrete or separate may be combined or integrated with other components, systems, modules, techniques, or methods without departing from the scope of the present invention. Other examples of changes, substitutions, and alterations are readily ascertainable by one skilled in the art and could be made without departing from the spirit and scope of the present invention.

What is claimed is:

1. A method for electronically detecting fraudulent use of a coin in a parking meter, the method comprising:

detecting a coin traveling through a coin chute of the parking meter;

analyzing the coin traveling through the coin chute to determine whether the coin is valid;

crediting time to the parking meter for the coin where the coin analysis indicates that the coin is valid;

detecting the coin traveling in a reverse direction in the coin chute after crediting time to the parking meter; and removing the time credited to the parking meter by the coin in response to detecting the coin traveling in the reverse direction in the coin chute.

2. The method of claim 1, crediting time to the parking meter for the coin includes displaying time on a display of the parking meter.

3. The method of claim 1, further comprising using a coin discrimination component to analyze the coin traveling through the coin chute.

4. The method of claim 3, wherein the coin discrimination component is further defined as one or more optical sensors.

5. The method of claim 3, wherein the coin discrimination component is further defined as one or more electromagnetic sensors.

6. The method of claim 3, wherein the coin discrimination component is further defined as one or more coil oscillators.

7. The method of claim 3, wherein the coin discrimination component is further defined as one or more RF oscillators.

8. The method of claim 3, wherein the coin discrimination component is further defined as one or more Hall effect sensors.

9. The method of claim 1, a sensor detects entry of a coin into the chute.

10. The method of claim 9, wherein the sensor is selected from a group of sensor consisting of optical sensors, electromechanical sensors, coil oscillators, RE oscillators, and Hall effect sensors.

11. The method of claim 9, wherein a sensor is operable to promote activation or at least one parking meter component in response to detecting the corn traveling through the chute, the at least one parking meter component in a low power mode to conserve power before the sensor promotes activation of the at least one parking meter component to a power mode other than the low power mode.

12. The method of claim 11, wherein at least one component is monitored for detection of reverse travel of the coin in the chute only after time has been credited to the parking meter for the coin.

13. A coin fraud detection system for electronically detecting fraudulent control of a coin in a parking meter, the coin fraud detection system comprising:

a coin chute for receiving coins in the parking meter;

at least one electronic sensing device operably coupled to the coin chute to obtain information related to objects in the coin chute; and a processor coupled to receive information from the at least one electronic sensing device and credit time to the parking meter wherein the information indicates that the coin is valid, the processor further programmed to promote removal of time from the parking meter in response to information detecting reverse travel of the coin in the coin chute.

14. The coin fraud detection system of claim 13, wherein the at least one electronic sensing device is further defined as:

at least a first sensor operable to detect entry of the coin in the coin chute, at least a second sensor operable for analysis of the coin, and wherein the processor is further defined as operable to process signals from at least one of the first and second sensors to determine whether to credit time on the parking meter based at least in part on the analysis of the coin, the processor further operable in response to receiving a signal from at least one of the first and second sensors indicating reverse direction of travel of the coin in the chute to remove the time credited to the parking meter.

15. The coin fraud detection system of claim 13, further comprising a display and wherein the processor is operable to promote displaying of the time credited to the parking meter for the coin on the display.

16. The coin fraud detection system of claim 15, wherein when time is to be removed from the parking meter, the processor is operable to promote removal of the time being displayed on the parking meter display.

17. The coin fraud detection system of claim 13, wherein the at least one electronic sensing device is selected from a group consisting of optical sensors, electromagnetic seniors, coil oscillators, RE oscillators, and Hall effect sensors.

* * * * *

UNITED STATES PATENT AND TRADEMARK OFFICE

CERTIFICATE OF CORRECTION

PATENT NO. : 6,920,972 B2
DATED : July 26, 2005
INVENTOR(S) : Speas et al.

It is certified that error appears in the above-identified patent and that said Letters Patent is hereby corrected as shown below:

Column 4,
Line 66, replace “REF” with -- RF --.

Column 5,
Line 67, replace “,” with -- . --.

Column 8,
Line 45, replace “group of sensor” with -- group of sensors --.
Line 14, replace “seniors” with -- sensors --.
Line 15, replace “RE” with -- RF --.

Signed and Sealed this

Twenty-seventh Day of September, 2005

JON W. DUDAS
*Director of the United States Patent and Trademark Office*